US007083209B2

(12) United States Patent
Leman et al.

(10) Patent No.: US 7,083,209 B2
(45) Date of Patent: Aug. 1, 2006

(54) HYDRAULIC OVERSHOT TOOL WITHOUT A NOZZLE, AND METHOD OF RETRIEVING A CYLINDER

(75) Inventors: Michael E. Leman, Houston, TX (US); Adrian Vuyk, Jr., Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 183 days.

(21) Appl. No.: 10/600,693

(22) Filed: Jun. 20, 2003

(65) Prior Publication Data

US 2004/0256871 A1 Dec. 23, 2004

(51) Int. Cl.
*E21B 31/18* (2006.01)

(52) U.S. Cl. ..... 294/86.17; 294/86.3

(58) Field of Classification Search ..... 294/86.15, 294/86.17, 86.26, 86.28, 86.3, 86.31; 166/98, 166/99

See application file for complete search history.

(56) References Cited

U.S. PATENT DOCUMENTS

| | | | | | |
|---|---|---|---|---|---|
| 1,795,322 | A | * | 3/1931 | Triplett | 294/86.15 |
| 2,621,960 | A | * | 12/1952 | Justice et al. | 294/86.15 |
| 3,199,906 | A | * | 8/1965 | Chenoweth | 294/86.15 |
| 3,208,788 | A | * | 9/1965 | Roark | 294/86.15 |
| 3,278,219 | A | * | 10/1966 | Elliston | 294/86.15 |
| 5,219,027 | A | | 6/1993 | Taylor | 166/377 |
| 5,242,201 | A | | 9/1993 | Beeman | 294/86.17 |
| 5,337,829 | A | | 8/1994 | Taylor | 166/377 |
| 5,495,902 | A | | 3/1996 | Hailey et al. | 175/296 |
| 5,580,114 | A | | 12/1996 | Palmer | 294/86.15 |
| 5,673,754 | A | | 10/1997 | Taylor, Jr. | 166/301 |
| 5,690,170 | A | | 11/1997 | Hailey et al. | 166/55 |
| 5,765,638 | A | | 6/1998 | Taylor | 166/98 |
| 5,865,253 | A | | 2/1999 | Gamper et al. | 166/301 |
| 5,875,842 | A | | 3/1999 | Wyatt | 166/178 |
| 5,931,242 | A | | 8/1999 | Oettli | 175/296 |
| 6,095,582 | A | | 8/2000 | Siniaguine et al. | 294/64.3 |
| 6,095,583 | A | | 8/2000 | Beeman et al. | 294/86.15 |
| 6,230,825 | B1 | | 5/2001 | Aumann et al. | 175/246 |
| 6,378,631 | B1 | | 4/2002 | Aumann et al. | 175/249 |
| 6,527,048 | B1 | | 3/2003 | Trosclair | 166/242.7 |

OTHER PUBLICATIONS

U.K. Search Report, Application No. GB0413616.4, dated Sep. 2, 2004.

"Bowen Series 150 Releasing and Circulating Overshot", Bowen Tools, Inc., Feb. 1986.

* cited by examiner

*Primary Examiner*—Dean J. Kramer
(74) *Attorney, Agent, or Firm*—Patterson & Sheridan, LLP

(57) ABSTRACT

The present invention provides an improved hydraulic overshot tool. The overshot tool mechanically engages a cylindrical body downhole attempting to be retrieved. In the event retrieval is unsuccessful, the overshot tool may be hydraulically released from the cylindrical body. The release function employs a pressure differential within the overshot tool, but without necessity of a nozzle within the bore of the tool.

28 Claims, 7 Drawing Sheets

HYDRAULIC OVERSHOT TOOL WITHOUT A NOZZLE, AND METHOD OF RETRIEVING A CYLINDER

BACKGROUND OF THE INVENTION

1. Field of the Invention

The present invention relates to retrieval tools. More specifically, the present invention pertains to overshot tools used for retrieving a cylindrical body that has become lodged or otherwise lost within a wellbore.

2. Description of the Related Art

In the formation of a hydrocarbon or other wellbore, a cylindrical hole is formed vertically through a series of earth formations. Typically, the wellbore is first formed by rotating a drill bit downward at the lower end of a drill string. Traditionally, the drill string has been lowered into the wellbore by threadedly connecting a series of pipe joints, and then rotating those pipe joints in order to impart rotational movement to the drill bit downhole.

During the drilling of a wellbore, it is not uncommon for the operator of the rig to lose the ability to rotate the drill bit downhole. In this respect, those of skill in the art will understand that wellbores generally are not formed in a perfectly vertical plane; instead, the movement of the drill bit tends to form a "corkscrew" profile as the drill bit moves downward into the earth. This, in turn, creates tremendous frictional forces, or "drag," between a drill string and a surrounding earth formation. A lower portion of the drill string may become fatigued and separate due to the high tongue forces imparted during the drilling process. When this occurs, the upper section of drill pipe must be removed from the hole, and a fishing tool deployed in an attempt to retrieve the parted lower portion of drill pipe and connected drill bit.

In order to retrieve the parted drill string left downhole, an overshot tool has been traditionally used. A well-known example of such an overshot tool is the Bowen Series 150 releasing and circulation overshot tool. An exemplary overshot tool of the Bowen-type is shown at 10 in FIG. 1. This overshot tool, and others of similar arrangement, has been known and used in the oil industry for many years.

As seen in FIG. 1, the overshot tool 10 first comprises a body 12. The body 12 defines an elongated tubular member having an upper end and a lower end. The upper end and the lower end are each internally threaded. The upper end is threadedly connected to a top sub 11. The top sub 11 serves as a connector between the body 12 of the overshot tool 10 and the working string (not shown). The lower end, in turn, is threadedly connected to a guide member 14. The guide member 14 aids in running the overshot tool 10 into the wellbore and over the parted drill string downhole for retrieval. Other tools, such as a circular milling tool, may also be attached below the body of the overshot tool. The milling tool (not shown) typically defines a cylindrical body having carbide material disposed there around.

As shown in FIG. 1, the inner diameter of the overshot tool body 12 has a serrated profile. This means that a series of ramp surfaces 16 are placed along the inner diameter of the body 12. In one arrangement, the ramp surfaces 16 are spiraled along the inner surface of the body.

A separate gripping member 18 is disposed within the body 12. Where the ramp surfaces 16 are spiraled, the gripping member 18 is also spiraled. For the overshot tool 10 of FIG. 1, the spiraled gripping member 18 is configured to nest within the ramp surfaces 16 of the body 12. This means that the outer diameter of the gripping member 18 is configured to ride along the ramps 16 of the inner surface of the tool body 12. An example of such a gripping member 18 for the overshot tool 10 is shown in FIG. 2.

Referring to FIG. 2, it can be seen that the gripping member 18 has a generally smooth outer surface, but a grooved inner surface. The inner grooves define wickers 19 used for gripping the outer diameter of a parted drill string or other cylindrical body downhole (sometimes referred to as a "fish"). To accomplish the gripping function, the wickers 19 are configured to define a series of upwardly facing and sharpened edges. The wickers 19 bite into the outer surface of the fish downhole (not shown) in order to accomplish the retrieval function of the overshot tool 10. To this end, the grapple 18 is slotted, allowing it to collapse around the cylindrical item downhole.

Referring again to FIG. 1, the overshot tool 10 has an inner bore 15 that extends along its length. The inner bore 15 is dimensioned to receive, or "swallow," the cylindrical body to be retrieved (not shown). The upper end of the cylindrical body to be retrieved tags the lower end of the top sub 11 as it is received within the overshot tool 10. To this end, the bottom end of the top sub 11 defines a reduced inner diameter portion that forms a shoulder 17. As the cylindrical body to be retrieved is received within the bore 15 of the overshot tool 10, the wickers 19 of the gripping member, or "grapple," frictionally engage the outer surface of the cylinder being retrieved. At the same time, as the operator of the rig senses that the cylinder to be retrieved has tagged the sub 17, the operator begins to pull on the working string. As the operator pulls upward on the working string, the smooth outer surface of the grapple 18 is forced to ride downward along the ramped surfaces 16 of the body 12. This, in turn, causes the grapple 18 to more tightly engage the cylinder being retrieved.

The Bowen-type overshot tool, such as the one shown in FIG. 1, has provided a reliable means for retrieving parted pipe and other cylindrical bodies which have become lost downhole. This is at least true in the case of more shallow and generally vertical wells. However, in some instances, a string of pipe or tool simply cannot be retrieved. In this situation, the overshot tool 10 must be released from the cylindrical pipe segment downhole and then removed from the wellbore. To accomplish separation of the overshot tool 10 from the cylindrical body downhole, the operator of the rig applies a downward load on the overshot 10 and rotates the working string to the right, causing the gripping member 18 to unthread from the gripped cylindrical body downhole. To this end, the wickers 19 on the inner surface of the grapple 18 are cut in a spiraled arrangement to allow "unthreading."

As noted, the Bowen overshot tool design has been a reliable standard for many years. It has proved successful in the more shallow wells and vertical wells historically drilled. However, during the last decade drilling activity (at least for the major U.S. oil companies) has shifted towards the drilling of deeper wells, and the drilling of lateral wells and extended reach wells. In these instances, the overshot tool 10 cannot be reliably released simply by "unthreading" the connection with the cylindrical body downhole. Those skilled in the art will understand that there is not a direct correlation between the rotation of the drill string at the surface of a well and rotation of the overshot tool downhole. This places the operator of a rig in a difficult dilemma when drilling a deep well or a well that is being drilled at a substantial angle of deviation. In this respect, the operator has two choices: (1) incur the expensive rig time needed in order to attempt to retrieve a downhole tool, such as an expensive drill bit carrying directional equipment, knowing that if the retrieval operation is unsuccessful the overshot tool will have to be left in the hole along with the expensive drilling or other equipment; or (2) avoid this risk and the expense of rig time and drill a new deviated hole in the wellbore at a measured depth above the point at which the drill pipe and connected tools have become lodged.

In an effort to make overshot tools more easily retrieved in the event of an unsuccessful retrieval operation, hydraulically released overshot tools have been developed. An example of such a hydraulically actuated overshot tool is found in U.S. Pat. No. 5,242,201 issued in 1993 to Beeman. The overshot tool in the '201 patent is hydraulically actuated for both catching and for releasing the fishing tool from the "fish." Another example of an overshot tool is seen in U.S. Pat. No. 5,580,114 issued in 1996 to Palmer. The '114 patent represents another hydraulically actuated overshot tool. In the tool of the '114 patent, the cylindrical fish sought to be retrieved is mechanically caught, and hydraulically released.

In both the '201 Beeman fishing tool and the '114 Palmer fishing tool, a nozzle is placed within the inner bore of the tool. Without describing details of operation of the respective tools, each tool each utilizes a nozzle in order to create a pressure differential above and below the outlet of the nozzle. In the '201 Beeman patent, the nozzle is identified as a tapered segment 56 of a mandrel 10. In the '114 Palmer patent, the nozzle is a collet body, identified as item 28 in FIG. 1, and item 58 in FIG. 5. The pressure drop is created through the injection of fluid into the working string under pressure. The pressure differential acts upon the nozzle, causing the nozzle to act as a piston member.

The use of hydraulically actuated overshot tools has the advantage of avoiding the necessity of turning the drill string to release the cylindrical body attempting to be retrieved. At the same time, the presence of a nozzle in the overshot tools of the prior art presents several disadvantages. First, the nozzle creates a restriction within the bore for running additional tools downhole. For example, it is sometimes desirable to deploy a shot charge downhole on a wire line. The shot charge is used to create acoustic energy in order to separate joints of pipe for retrieval downhole. Second, the nozzle is sometimes asked to serve a stop function for which it was not designed. In this regard, the top end of the cylindrical body being retrieved most commonly tags the nozzle as the overshot tool is being lowered downhole. This, in turn, jars the nozzle upward relative to the housing of the tool. Again, without discussing details of the overshot tool, this may end up canceling out the piston function of the overshot tool, causing the overshot tool to be irretrievably engaged to the cylindrical body downhole. If this occurs, the overshot tool cannot hydraulically release.

Another disadvantage to the use of hydraulically actuated overshot tools relates to the placement of the proper pressure differential above the nozzle. In this respect, the item being retrieved from the well is commonly plugged or severely restricted. An example is where a mud motor is lodged at the lower end of a wellbore. This situation prevents pumping at a high enough flow rate to generate the pressure drop needed across the nozzle in order to actuate the tool. Still further, the inner diameter of the nozzle in a hydraulically actuated overshot tool prevents the use of extensions in the overshot. Sometimes, particularly when retrieving a mud motor, the overshot tool must be configured to "swallow" the shaft in order to frictionally engage the housing of the mud motor.

It can thus be seen then that a need exists for an improved overshot tool that employs the gripping capability of the Bowen-type overshot tool, but does not require turning of the drill string in order to effectuate a release of the overshot tool from the item being retrieved. Stated another way, a need exists for an overshot tool having the benefits of the Bowen-type fishing tool, but that does not require "unthreading" of the tool from the item being retrieved in the event retrieval is not successful. Further, a need exists for an overshot tool that can be hydraulically released from an item being retrieved, but which does not employ a nozzle within the bore of the overshot tool. Still further, a need exists for an overshot tool which can be hydraulically released from an item attempting to be retrieved from a wellbore, but which accommodates extensions so as to "swallow" elongated portions of the item being retrieved.

SUMMARY OF THE INVENTION

The present invention provides an improved hydraulic overshot tool. The overshot tool mechanically engages a cylindrical body downhole attempting to be retrieved. In the event retrieval is unsuccessful, the overshot tool may be hydraulically released from the fish. The release function employs a pressure differential within the overshot tool, but without necessity of a nozzle within the bore of the tool.

The overshot tool first comprises a housing. The housing defines an elongated tubular member having an inner surface and an outer surface. The inner surface includes a serrated profile that forms a plurality of ramp surfaces. The ramp surfaces are angled downward. The outer surface of the housing, in turn, forms an annular region between the tool and the surrounding wellbore.

A gripping member is placed along the inner surface of the tool housing. The gripping member likewise defines a tubular body having an inner surface and an outer surface. The inner surface includes a series of teeth for frictionally engaging the outer surface of a cylindrical body being retrieved. The outer surface, on the other hand, includes a profile that forms a plurality of ramp surfaces. The ramp surfaces are angled upward, and are configured to slidably nest along the ramp surfaces of the housing. The gripping member slides downward relative to the housing when a cylindrical body to be retrieved is frictionally engaged. This causes the gripping member to contract around the fish.

The overshot tool further comprises a piston. The piston likewise defines a tubular member. The piston is operatively connected to the top end of the gripping member. The piston is movable relative to the housing in order to release the gripping member from the cylindrical body downhole. More specifically, the piston is slidably disposed along the inner surface of an upper portion of the body. Together, the upper and central body portions form the housing. Thus, movement of the piston serves to move the gripping member.

The piston includes an upper shoulder surface and a lower shoulder surface. The upper shoulder surface is in pressure communication with the annular region around the tool. This is accomplished by fabricating a low-pressure port into the upper body portion. The lower shoulder surface is in pressure communication with the inner surface of the housing. Thus, the injection of fluid into the bore of the tool at a sufficiently high flow rate will cause the lower shoulder surface to act as a piston surface, urging the piston to move upward relative to the housing of the tool. Upward movement of the piston, in turn, pulls the gripping member upwards, allowing it to be released from a cylindrical body lodged within the wellbore.

It can thus be seen that hydraulic release of the cylindrical body downhole is accomplished without use of a nozzle in the overshot tool.

BRIEF DESCRIPTION OF THE DRAWINGS

So that the manner in which the above recited features of the present invention can be understood in detail, a more particular description of the invention, briefly summarized above, may be had by reference to the appended drawings. It is to be noted, however, that the appended drawings (FIGS. 3–7) illustrate only typical embodiments of this invention and are therefore not to be considered limiting of its scope.

FIG. 3 is broken into FIG. 3(1) and FIG. 3(2) for clarification.

FIG. 6 shows a cross-sectional view of the overshot tool of FIG. 5, but with hydraulic fluid being injected into the wellbore. Hydraulic pressure within the piston has caused the piston to move upwardly within the upper body portion of the tool. This, in turn, pulls the gripping members upwardly along the ramp surfaces of the central body portion of the tool, allowing the gripping members to release the item in the wellbore.

" In FIG. 8, the item to be retrieved includes a long shaft that has been received within the overshot tool.

DETAILED DESCRIPTION OF THE PREFERRED EMBODIMENT

Figure 3:
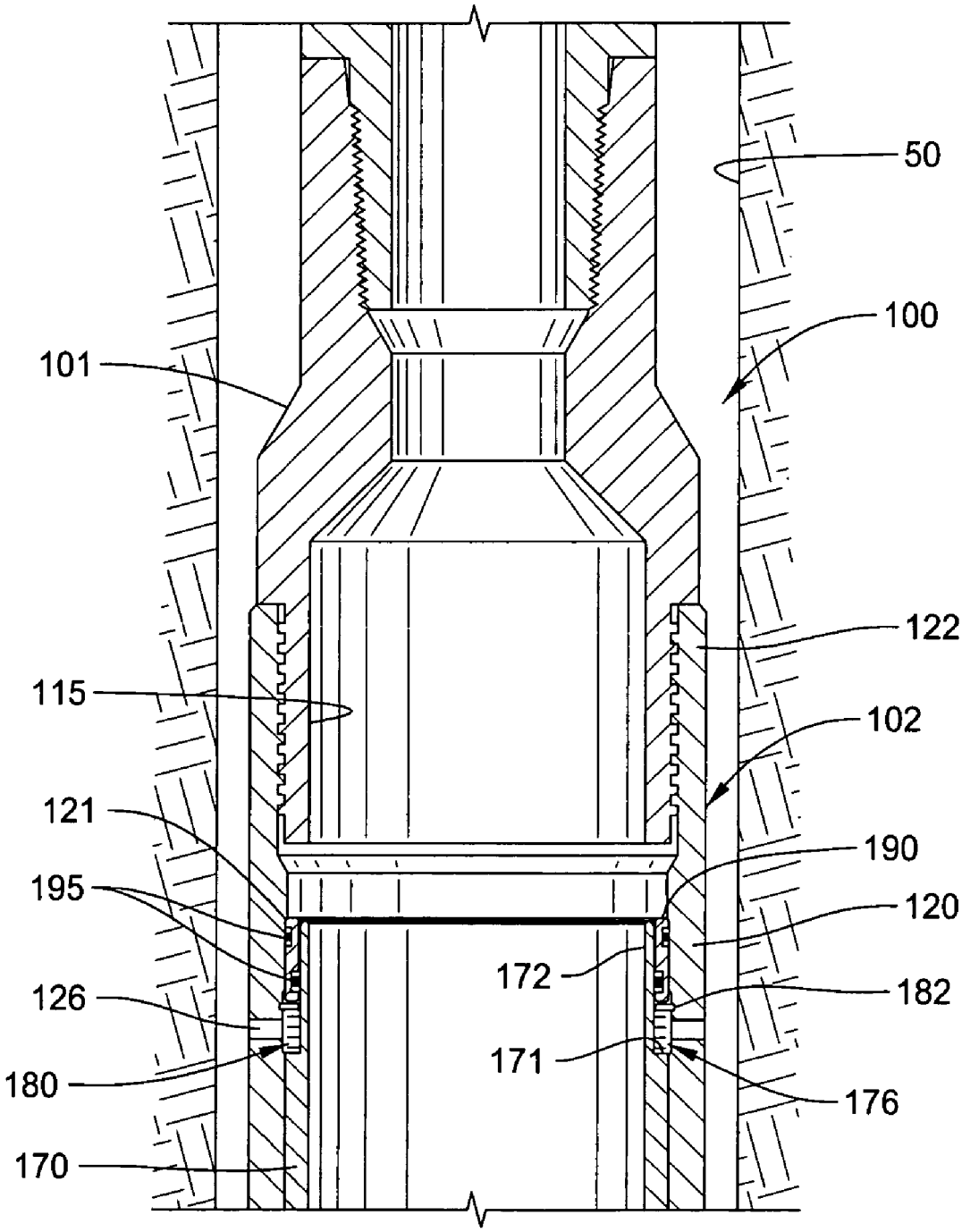
FIG. 3 presents a cross sectional view of an overshot tool of the present invention in one embodiment. In this view, the overshot tool is in its "run-in" position. It can be seen that a cylindrical item is being received within the bore of the overshot tool for later retrieval.
Figure 3:
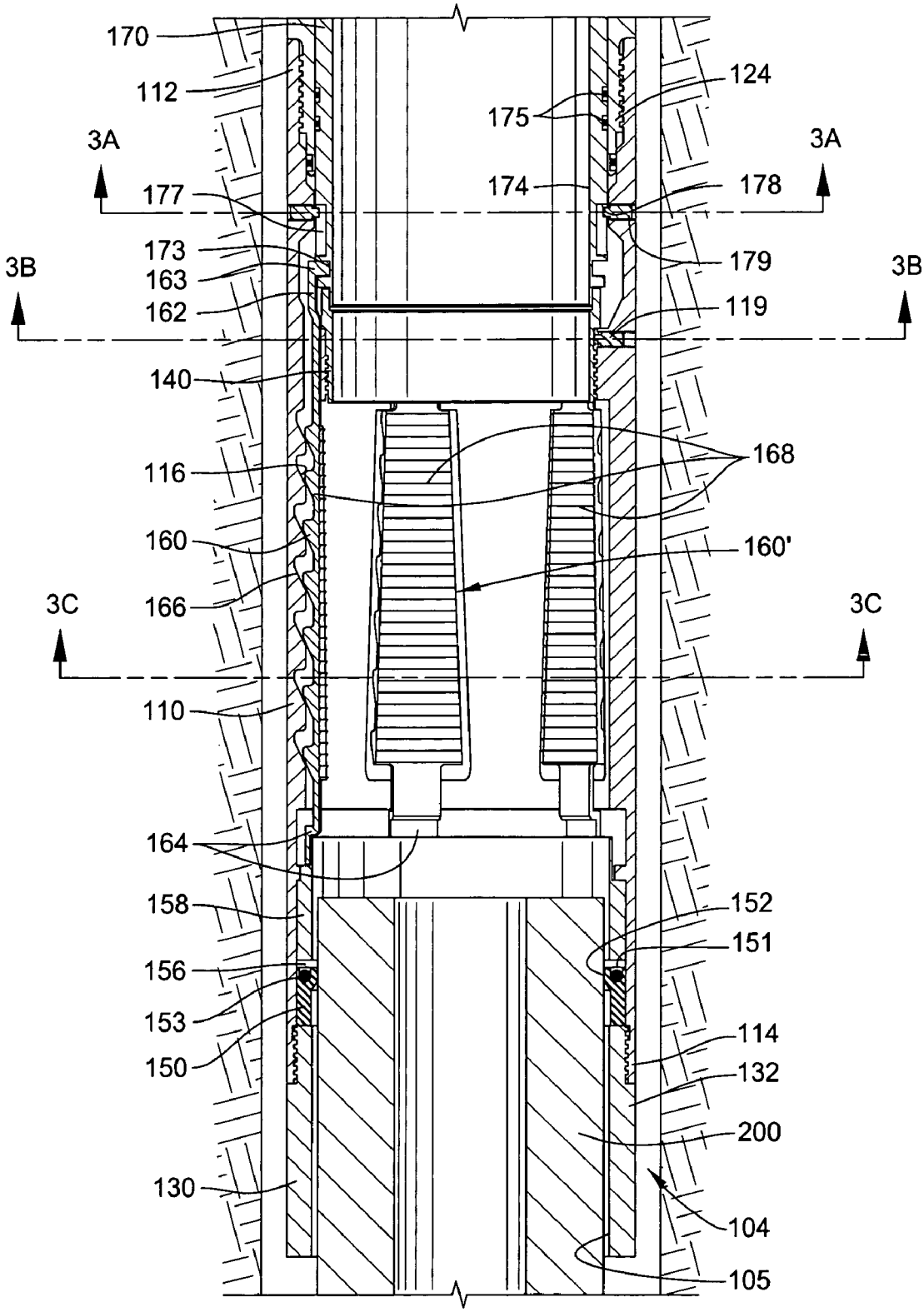

FIG. 3 presents a cross-sectional view of an overshot tool 100 of the present invention, in one embodiment. For clarification, the view is broken into FIG. 3(1) and FIG. 3(2). The overshot tool 100 is in its "run-in" position. In this respect, the tool 100 is capable of being run into a wellbore 50 in order to retrieve a cylindrical item 200 downhole. The top end of the cylindrical item 200 can be seen in the view of FIG. 3(2), beginning to be received within a bore 115 of the overshot tool 100.

The overshot tool 100 generally defines an elongated tubular body having an upper end 102, a lower end 104, and a bore 115 formed there between. It is understood that the terms "upper end" and "lower end" are for ease of reference only, and that the tool has utility both in vertical and in laterally or horizontally drilled wellbores. Thus, "upper end" simply refers to the end of the tool 100 most closely connected to the work string, while "lower end" refers to the direction of the tool 100 that first receives an item 200 being fished from the wellbore 50.

The overshot tool 100 first comprises a central body 110. The central body 110 itself defines a tubular member having an upper end 112 and a lower end 114. Preferably, both the upper 112 and the lower 114 ends of the body 110 include threads placed along the inner surface of the body 110. The threads enable threaded connections with other members, as will be discussed below.

The central body 110 has an outer surface and an inner surface. The outer surface is preferably smooth. However, the inner surface of the body 110 includes a serrated profile. In this respect, the inner surface of the central body 110 comprises a plurality of ramped surfaces 116 which form a serrated pattern along the longitudinal plane of the tool 100. In one arrangement, five separate sets of ramp surfaces 116 are provided along the inner diameter of the body 110. The number of ramp surfaces 116 is not important, so long as there are at least two.

In the arrangement for the overshot tool 100 of FIG. 3, the tool 100 next comprises an upper body 120. The upper body 120 defines a tubular member residing above the central body 110 of the tool 100. The upper body 120 has an upper end 122 and a lower end 124. The upper 122 and lower 124 ends are preferably threaded. In the view of FIG. 3, the upper end 122 includes threads along its inner diameter. The upper end 122, in turn, threadedly connects to a top sub 101. The top sub 101 is configured to threadedly connect to a working string, (not shown) for running the overshot tool 100 into and out of the wellbore 50.

The lower end 124 of the upper body 120 has a threaded outer diameter. It can be seen in FIG. 3(2) that the lower end 124 of the upper body 120 threadedly connects to the upper end 112 of the central body 110. In this manner, the upper 120 and central 110 bodies form a cylindrical housing. To this end, the outer diameter of the upper body 120 preferably aligns with the outer diameter of the central body 110.

One or more ports 126 are provided through the upper body 120. The ports 126 provide fluid communication between the tool 100 and the annulus defined by the tool 100 and the surrounding wellbore 50. In the operation of the overshot tool 100, the ports 126 serve as low-pressure ports 126. As will be described more fully below, the lower pressure ports 126 serve in forming a pressure differential for hydraulically actuating the releasing function of the overshot tool 100.

An optional additional body 130 may be placed below the central body 110 to further elongate the housing. As can be seen from the overshot tool 100 shown in FIG. 3(2), a tubular guide member 130 may be disposed below the central body 110. The guide member 130 also has an upper end 132 and a lower end. The upper end 132 of the guide 130 threadedly connects to the lower end 114 of the central body 110. As shown, the lower end of the guide has a straight inner surface 105. Alternatively, the lower end of the guide 130 may be dimensioned to assist the overshot tool 100 in "swallowing" the cylindrical item 200 downhole being retrieved. To this end, the lower end of the guide 130 may employ a tapered inner surface in order to serve a guiding function.

Instead of connecting to the guide 130, the lower end 114 of the central body 110 may connect to other tools downhole. Examples include a wash pipe (not shown) and a circular washover mill (also not shown).

As can be seen, the overshot tool 100 defines an elongated tubular tool. In the arrangement of FIGS. 3(1)–3(2), the upper body 120, central body 110, and guide body 130 together form the housing for the overshot tool 100. A uniform outer diameter is preferably formed by these three bodies, 120, 110, 130. However, the inner diameter along the bore 115 of the tool 100 is profiled, as follows.

First, a stop member 140 is provided along the tool 100. The stop member 140 creates a shoulder along the bore 115 of the tool 100 for tagging the top end of the item 200 being retrieved. This means that the stop member 140 limits the extent to which the fish 200 may be "swallowed." In one embodiment, the stop member 140 defines a stop ring. The ring 140 is placed along the overshot tool 100 proximate to the upper end 112 of the central body 110.

Next, a packoff 150 is provided along the length of the overshot tool 100. Preferably, the packoff 150 defines a pliable cylindrical item disposed proximate to the lower end 114 of the central body 110. The packoff 150 serves as a seal along the inner diameter of the overshot tool 100. In the arrangement shown in FIG. 3, the packoff 150 includes a recess 151. The recess 151 forms an upper lip 152 that provides a sealed engagement with a cylindrical item 200 as it is received in the bore 105 of the tool 100. A spring 153 is disposed within the recess 151 of the packoff 150 to aid in the seal function for the lip 152.

An additional profile within the bore 115 of the overshot tool 100 is provided by a gripping apparatus. A gripping apparatus is shown, in one embodiment, at 160 in FIG. 3(2). The gripping member 160 includes an outer surface and an inner surface. The outer surface constitutes a serrated profile made up of a series of ramp surfaces 166. At least two ramp surfaces 166 are provided along the outer surface of the gripping apparatus 160. The ramp surfaces 166 on the outer surface of the gripping apparatus 160 are configured to nest with and to slidably ride along the ramp surfaces 116 on the inner surface of the central body 110. Relative movement between the ramp surfaces 166, 116 causes the gripping apparatus 160 to move radially inwardly within the bore 115 of the overshot tool 100. Thus, a means is provided for frictionally engaging the cylindrical item 200 in order to retrieve it from the wellbore 50.

The gripping apparatus 160 also includes an inner surface, as noted. The inner surface is profiled so as to provide a series of gripping teeth, or "wickers" 168. The wickers 168 serve to bite into the outer surface of the fish 200 being retrieved. The wickers 168 are preferably oriented at an upward angle to aid in biting into the fish 200.

In the arrangement shown in FIG. 3, the gripping apparatus 160 is defined by a plurality of separate slip members 160'. Each slip member 160' includes a separate upper tang 162 and lower tang 164. The upper tangs 162 are operatively connected to the lower end 174 of a piston 170. The lower tangs 164, in turn, are nested between the central body 110 and a packoff sleeve 158. The packoff sleeve 158 is disposed immediately above the packoff 150. An optional gap 156 is retained between the packoff sleeve 158 and the packoff 150 in order to accommodate any expansion of the packoff 150 downhole.

In the arrangement for the gripping apparatus 160 shown in FIG. 3, five separate slip members 160' are shown. However, it is a matter of designer's choice as to the number of slip members 160' and the manner in which they are connected or not. In this respect, an optional slip ring (not shown) may be used to connect the separate slip members 160'. In one arrangement, the slip members 160' substantially recede into the housing, e.g., central body 110, when the slip members 160' nest along the ramp surfaces 116.

The overshot tool 100 shown in FIG. 3 next comprises a piston 170. The piston 170 defines a short tubular body that resides along the inner diameter of the upper body 120. The piston 170 has an upper end 172 and a lower end 174. The upper end 172 has a reduced wall thickness so as to form a pocket 176 along the outer diameter of the piston 170. The pocket 176 aligns with the low-pressure ports 126 in the upper body 120. The lower end 174 of the piston 170 includes several J-slots 173. The J-slots 173 are configured to receive shoulders 163 within the upper tang 162 of the gripping apparatus 160. Thus, the piston 170 and the gripping apparatus 160 are operatively connected. In the arrangement of FIG. 3, the piston 170 is operatively connected to the separate slip members 160'. As will be shown, translation of the piston 170 along the longitudinal axis of the overshot tool 100 causes reciprocal translation of the gripping apparatus 160, i.e., slip members 160', along the ramp surfaces 116 of the central body 110.

The lower end 174 of the piston 170 also includes a reduced wall thickness portion. The reduced wall thickness portion forms one or more gaps 177 between the outer diameter of the piston 170 and the inner diameter of the central body 110. One or more set screws 179 are placed along the gaps 177 in order to prevent rotation of the piston 170 within the overshot tool 100. The inner diameter of the piston 170 is preferably dimensioned to receive a wireline-deployed string shot.

The piston 170 is biased in a downward position. This, in turn, biases the connected gripping apparatus 160 downward, causing the gripping apparatus 160 to slide radially inward within the bore 115 of the overshot tool 100. Stated another way, the ramp surfaces 166 of the gripping apparatus 160 are biased to ride downwardly along the reciprocal ramp surfaces 116 of the central body 110.

In order to accomplish the biasing function, a biasing member 180 is provided. In the arrangement shown in FIG. 3(1), the biasing member 180 defines a spring. More specifically, the spring 180 preferably comprises a nested wave spring. The nested wave spring 180 is biased in compression, meaning that it desires to expand in order to push the piston 170 and gripping apparatus 160 downward.

The wave spring 180 resides within the pocket 176 around the piston 170. The pocket 176 is defined on one side by an upper shoulder 171 on the piston 170. The spring 180 acts against the shoulder 171 of the piston 170 to urge the piston 170 downward. Opposite the shoulder 171 in the pocket 176 is a snap ring 182. The snap ring 182 is fixed within the inner surface of the upper body 120. The snap ring 182 serves as an upper shoulder for the spring 180.

It should also be noted that the pocket 176 around the upper end 172 of the piston 170 forms a travel area. In this respect, the piston 170 is able to travel upwardly along a substantial length of the pocket 176, subject to overcoming the compressive force within the spring 180. At the same time, seals 175 are disposed at the interface of the outer surface of the piston 170 and the inner surface of the upper body 120. As will be described further below, an increase in hydraulic pressure within the bore 115 of the overshot tool 100 will cause the piston 170 and connected gripping apparatus 160 to move upward relative to the housing, i.e., upper body 120 and central body 110 of the tool 100. Travel of the piston 170 and connected gripping apparatus 160 is limited by the geometry of the pocket 176 and the wave spring 180 nested therein.

An additional optional feature for the overshot tool 100 is shown in FIG. 3(1). That feature is an upper shoulder piece 190. The upper shoulder piece 190 is placed around the upper end 172 of the piston, between the piston 170 and the surrounding upper body 120 and above the snap ring 182. Seals 195 are placed at the interfaces between the shoulder piece 190 and the piston 170, and between the shoulder piece 190 and the surrounding upper body 120. The upper shoulder piece 190 butts against an inner shoulder 121 along the upper body 120. In addition, the snap ring 182 aids in retaining the upper shoulder 190 in its position within the upper body 120. The upper shoulder piece 190 aids in the manufacturing process for the tool 100. More specifically, it aids in the installation of the biasing member 180 within the piston pocket 176. Of course, it is understood that other configurations, arrangements and details may be provided in the manufacture of the overshot tool without departing from the scope of the present invention.

Figure 3A:
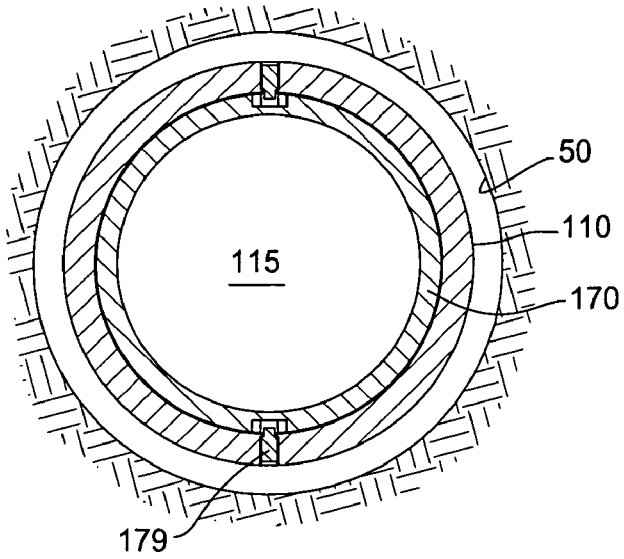
FIG. 3A provides a cross-sectional view of the overshot tool of FIG. 3. The cross section is taken across line A—A of FIG. 3(2). The view is cut through the piston and the central body of the overshot tool.
Figure 3B:
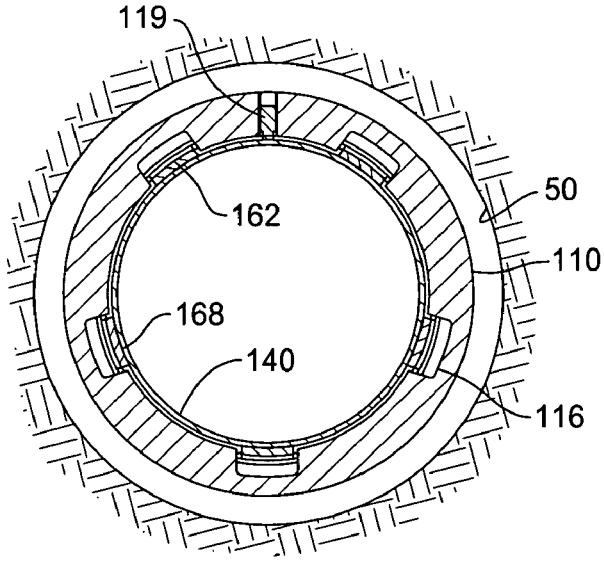
FIG. 3B shows another cross-sectional view of the overshot tool of FIG. 3. In this view, the section is cut across line B—B of FIG. 3(2). Visible in this view is the upper end of each of five gripping means within the central body for the tool.

Several transverse cross sectional views are provided in order to aid in an understanding of the overshot tool 100 shown in FIG. 3. First, FIG. 3A presents a cross-sectional view of the overshot tool 100 of FIG. 3(2), cut through lin A—A. Visible in FIG. 3A is the central body 110 of the overshot tool 100. Along the inner surface of the central body 110 is the lower end 174 of the piston 170. Line A—A intersects at the level of the set screws 179. Two set screws 179 are seen. As noted above, the set screws 179 maintain a rotational fix between the piston 170 and the surrounding central body 110. A plurality of slips 160 is seen in FIG. 3B. Five separate slips 160 are shown in this embodiment. Together, the slips 160 define the gripping apparatus.

Next, FIG. 3B provides a cross sectional view of the overshot tool 100 of FIG. 3(2), cut through line B—B. Visible again in this view is the surrounding central body 110 of the tool 100. The thickness of the body 110 at this level is greater than the thickness of the body shown in FIG. 3A. The plurality of ramp surfaces 116 is seen along the inner surface of the body 110. At this level, the upper tang 162 of the respective slips 160 is seen in cross section is seen in FIG. 3B. In addition, the cylindrical stop ring 140 is seen within the slips 160.

A set screw 119 is also visible in the view of FIG. 3B. The set screw 119 serves to keep the stop ring 140 from backing off the body 110 of the tool 100. In this respect, the stop ring 140 is preferably hand threaded onto the central body 110 during manufacture.

Figure 3C:
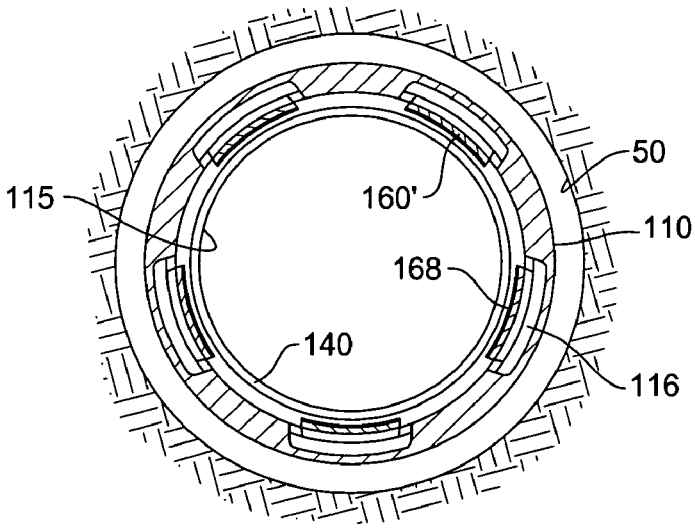
FIG. 3C is yet another cross-sectional view of the overshot tool of FIG. 3. Here, the section is taken across line C—C of FIG. 3(2). In this view, the gripping means can be seen within the central body.

Next, FIG. 3C presents yet another cross sectional view of the overshot tool 100 of FIG. 3(2). Here, the cut is taken along line C—C. Line C—C is also cut through the central body 110 of the tool 100; however, line C—C is at a level along the overshot tool 100 that is lower than line A—A and line B—B. The various slip members 160' are seen within the central body 110. The bottom of the stop ring 140 is also seen.

As noted, FIG. 3 shows a cylindrical item 200, or "fish," to be retrieved within the wellbore 50. The cylindrical item 200 is first being received within the guide body 130 of the overshot tool 100. In order to further understand operation of the overshot tool 100 of the present invention, a progressive series of drawings is provided. Use of the overshot tool 100 in various stages of operation is shown in FIGS. 3, 4, 5 and 6.

Figure 4:
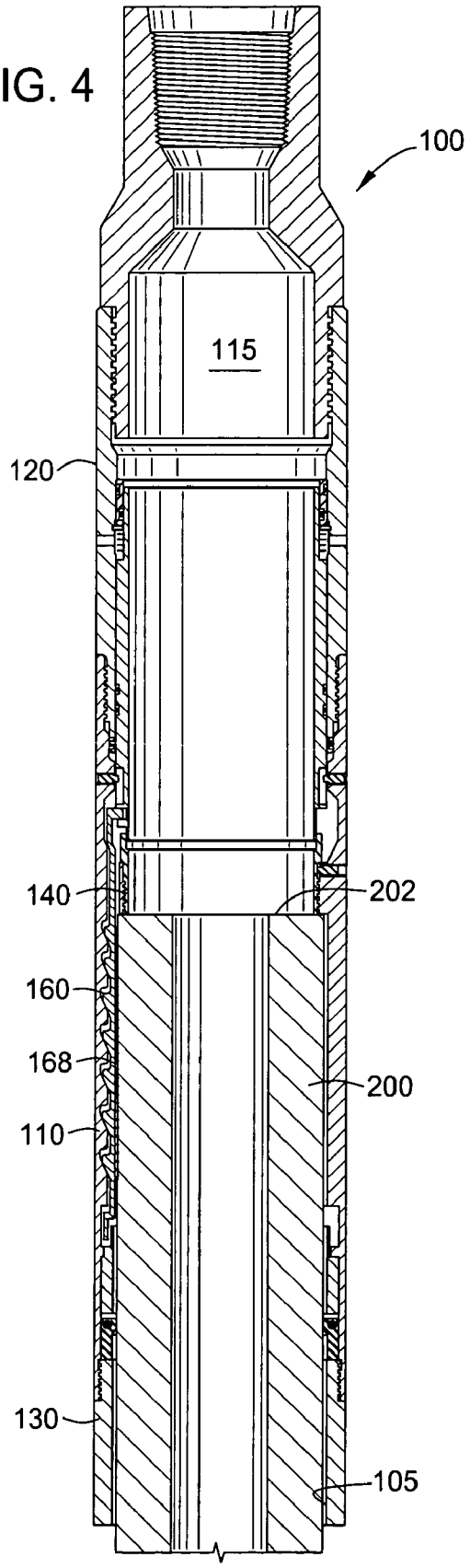
FIG. 4 presents a cross-sectional view of the overshot tool of FIG. 3. In this view, the cylindrical item to be retrieved has been received within the overshot tool. The top of the item being retrieved has engaged the stop ring of the overshot tool, so that the cylindrical item is ready to be pulled.

Moving now to FIG. 4, FIG. 4 presents a cross-sectional view of the overshot tool 100 of FIG. 3. In this view, the fish 200 has been more fully received within the bore 115 of the tool 100. More specifically, a top end 202 of the cylindrical item 200 has "tagged" the stop member 140 of the overshot tool 100. At this point, the cylindrical item 200 has been fully received within the guide 130 and central body 110 sections. At the same time, the cylindrical item 200 has been received within the gripping apparatus 160. A sufficient amount of clearance is designed within the slip members 160' to permit the outer diameter of cylindrical item 200 to pass within the wickers 168 of the sup members 160' when the overshot tool 100 is in its releasing position.

Figure 5:
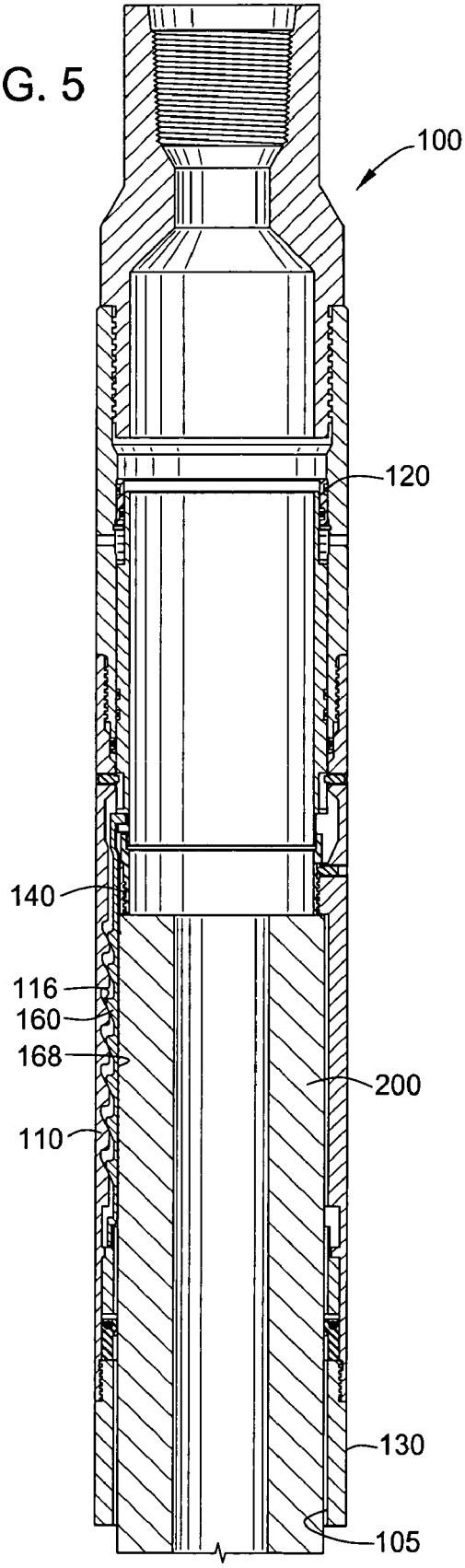
FIG. 5 provides a cross-sectional view of the overshot tool of FIG. 4, in the next step for retrieving the cylindrical item. In this view, tension is being pulled on the working string (not shown) in order to retrieve the cylindrical item from the wellbore. The gripping means within the overshot tool has frictionally engaged the outer surface of the fish. In addition, the outer surface of the gripping means has advanced downward along the ramped surfaces of the body of the overshot tool. In this way, further gripping force is applied to the cylindrical item being retrieved while tension is being applied to the overshot tool.

Referring now to FIG. 5, FIG. 5 presents a next cross-sectional view of the overshot tool 100 of FIG. 3. In this view, tension is being applied to the working string (not shown) and connected overshot tool 100. Typically, tension is supplied by the rig operator pulling on the work string, and transmitting the tensile force through the top sub 111 and then to the upper body 120 of the tool 100.

Because of the small clearance between the inner surface of the slip members 160' and the outer surface of the cylindrical item 200 being retrieved, upward movement of the overshot tool 100 causes the wickers 168 (or other frictional gripping surface) along the slip members 160' to engage and catch the outer diameter of the cylindrical item 200 downhole. Preferably, the individual wickers 168 define sharpened teeth radially disposed along the inner surface of the slip members 160' for aid in biting into the cylindrical item 200. As additional tensile force is transmitted through the housing 120, 110 of the overshot tool 100, the housings 120, 110 are raised within the wellbore 50. However, because the slip members 160' have engaged the cylindrical item 200, the slip members 160' resist upward movement. Instead, the slip members 160' are urged to slide relatively downwardly along the respective ramp surfaces 116 of the central body 110. Because of the angle of the ramp surfaces 116, the slip members 160' are driven radially inwardly towards the fish 200. Thus, additional upward force applied to the overshot tool 100 causes additional gripping force to be applied against the fish 200 as retrieval is attempted.

At this point, it should be noted that the overshot tool 100 has utility in any type of well, whether it is being completed vertically, horizontally, laterally or in an extended reach arrangement. Tagging of the top of a cylindrical item 200 downhole, whether it be a joint of drill pipe, a cylindrical housing from a mud motor, or some twisted off piece of tool, can be tagged against the stop member 140. In this way, positioning of the overshot tool 100 along the cylindrical item being retrieved 200 can be reliably determined regardless of wellbore configuration. Additional benefits of the overshot tool 100 will be realized from the discussion of the hydraulic release function of the tool 100, below.

In many wellbore completion operations, the operator is unable to retrieve the cylindrical item 200 from within the wellbore 50. This can be attributed to a variety of causes, including collapse of the hole around a lower portion of the drill string, a highly deviated angle of wellbore orientation causing frictional engagement between the drill string and surrounding wellbore, and other factors. In any instance, it is desirable for the operator to be able to release the overshot tool 100 from the cylindrical item 200 downhole in the event the fishing operation is unsuccessful. In this way, the operator is not placed in the embarrassing situation of leaving more equipment downhole than was originally stuck.

Figure 1:
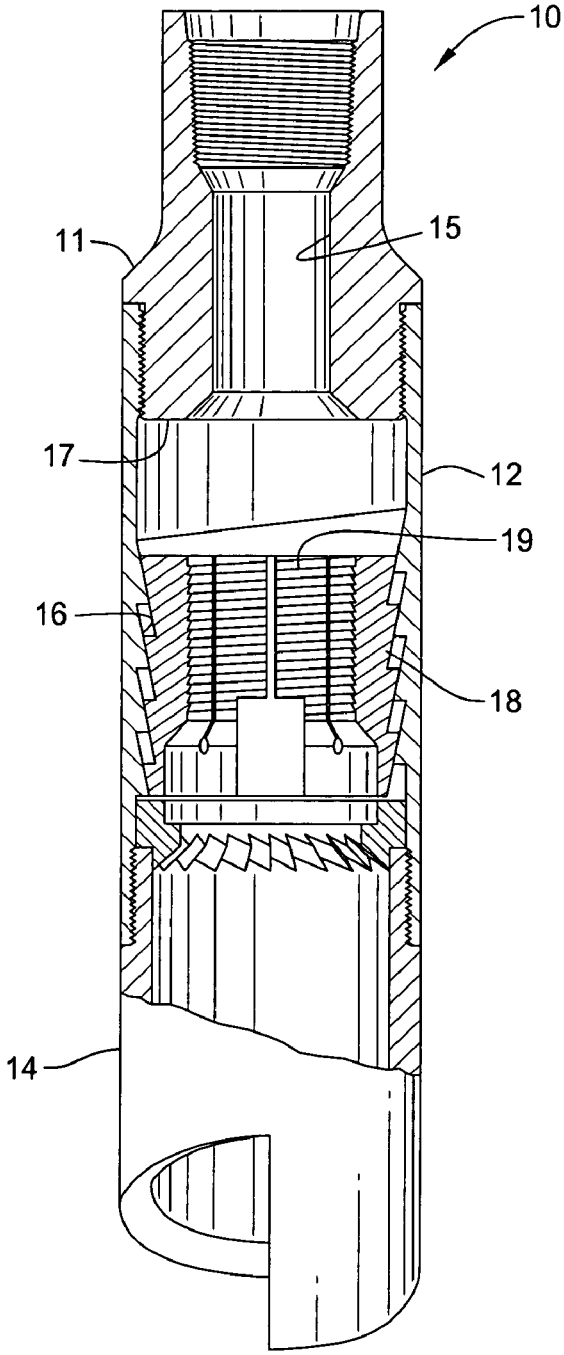
FIG. 1 (PRIOR ART)
FIG. 1 presents a cross-sectional view of an overshot tool as known in the prior art. This tool is fabricated as a Bowen-type overshot tool.
Figure 2:
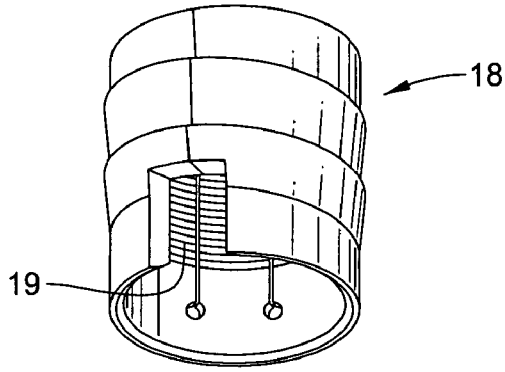
FIG. 2 (PRIOR ART)
FIG. 2 presents a perspective view of a gripping member as might be used within the Bowen-type overshot tool of FIG. 1. In this arrangement, the gripping member constitutes a helically threaded grapple.

With the known Bowen-type overshot tool (FIG. 1), release of the tool 10 from an item stuck downhole must be accomplished manually. As described above, the operator must rotate the drill string to the right in an attempt to unthread the tool 10 from the stuck item. However, in the instance of extended reach wells, deviated wells or even very deep substantially vertical wells, rotation of the working string does not necessarily impart the needed rotation of the overshot tool. Accordingly, the overshot tool 100 of the present invention provides a mechanism by which the tool 100 can be hydraulically released. More specifically, the overshot tool 100 is released by the injection of fluid into the bore 115 of the tool 100.

Figure 6:
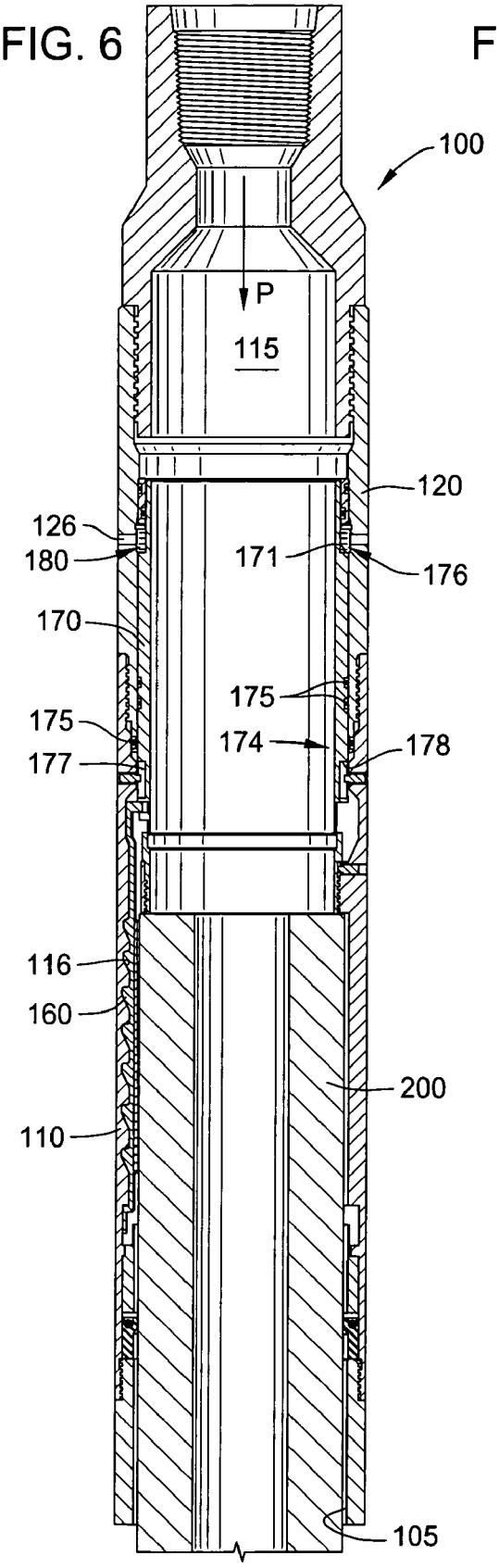
FIG. 6 demonstrates a release of the item within the wellbore.

FIG. 6 presents the releasing step for the overshot tool 100 of FIG. 3. In this view, the overshot tool 100 is being released from the cylindrical item 200 within the wellbore 50. Hydraulic force (indicated by arrow P) is being applied within the bore 115 of the overshot tool 100. To accomplish this, fluid is injected down the working string, the top sub 111, and into the bore 115 of the tool 100. Increased pressure within the bore 115 is created by increasing the flow rate through the working string. It is also anticipated that some flow restriction will exist downhole below the overshot tool 100, contributing to the needed pressure drop. The restriction may be in the form of the drill bit, a downhole mud motor, another tool, or even portions of formation collapse itself opposite the bit. In any instance, a pressure differential is created between the inner bore 115 of the tool 100, and the surrounding annular region.

As fluid is injected into the overshot tool 100 under pressure, it invades the gap 177 formed around the lower end 174 of the piston. An upper shoulder 178 is provided along the gap 177 in order to create a piston area. Seals 175 seal the interfaces along the outer surface of the piston 170, i.e., along the inner diameter of the upper body 120, and along the inner surface of the central body 110. Thus, fluid injected into the overshot tool 100 under pressure acts upwardly against shoulder 178 of the piston 170.

As noted above, low pressure ports 126 are provided in the upper body 120 of the tool 100. This allows for pressure communication from the annulus into the pocket 176 formed between the piston 170 and surrounding upper body 120. As fluid continues to be injected into the bore 115 of the tool 100 at a higher rate, the pressure within the gap 177 becomes significantly greater than pressure within the pocket 176. This, in turn, causes the piston 170 to move upwardly relative to the tool housing, i.e., upper body 120 and central body 110. Ultimately, this pressure differential exceeds the downward force applied by the biasing member, i.e., nested wave spring 180, causing the upper shoulder 171 in the piston 170 to travel upward in the pocket 176.

As described above, the piston 170 is operatively connected to the slip members 160'. Upward movement of the piston 170 causes the slip members 160' to slide upwardly along the inclined or ramped surfaces 116 in the central tool body 110. This, in turn, causes the slip members 160' to be retracted radially inward and away from the cylindrical item 200 within the wellbore 50. In this manner, the gripping apparatus 160 is released from the fish 200 downhole.

Figure 7:
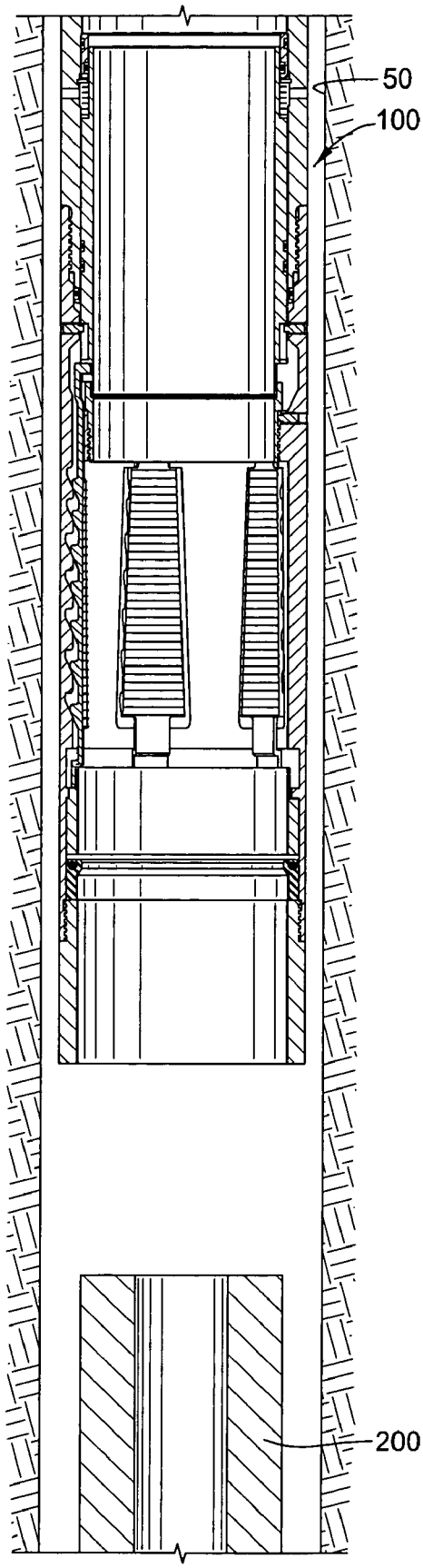
FIG. 7 shows the item within the wellbore having been released. The overshot tool is being removed from the wellbore, leaving the item in the wellbore as it was before FIG. 3.

FIG. 7 presents yet a next progression in operation of the overshot tool 100 of FIG. 3. In FIG. 7, the overshot tool 100 is in its released position. This position is identical to the run-in position shown in FIG. 3. The overshot tool 100 is now moving out of the hole, leaving the cylindrical item 200 permanently within the wellbore 50. Those of ordinary skill in the art will understand that, unless the cylindrical item 200 can be retrieved, a whipstock (not shown) will need to be run into the wellbore and a new lateral wellbore drill at a measured depth above the cylindrical item 200. At the same time, the rig operator is spared the embarrassment and considerable additional expense of having to leave not only the cylindrical item 200 (and any connected expensive equipment) downhole, but his own fishing tool as well.

It can be seen from FIGS. 3–7 that the overshot tool 100 of the present invention can be released from a cylindrical item downhole without necessity of a nozzle. This provides significant advantages for the overshot tool 100 of the present invention, as compared to overshot tools of the prior art.

It can also be seen that a new method is provided for retrieving a tubular body from a wellbore. In summary, the method provides a first step of running an overshot tool into the wellbore. The overshot tool is the tool 100 described above. The tool 100 is run into the wellbore on a working string. Next, the tubular body to be retrieved is tagged using the overshot tool 100. Finally, the working string is pulled, thereby causing the gripping apparatus 160 of the overshot tool 100 to frictionally engage and grip the tubular item.

If it is desirable to release the tubular body from the overshot tool 100, an additional step may be taken. In this respect, fluid is injected into the working string and the connected overshot tool 100, under pressure. This serves to release the gripping apparatus 160 from the tubular body.

Figure 8:
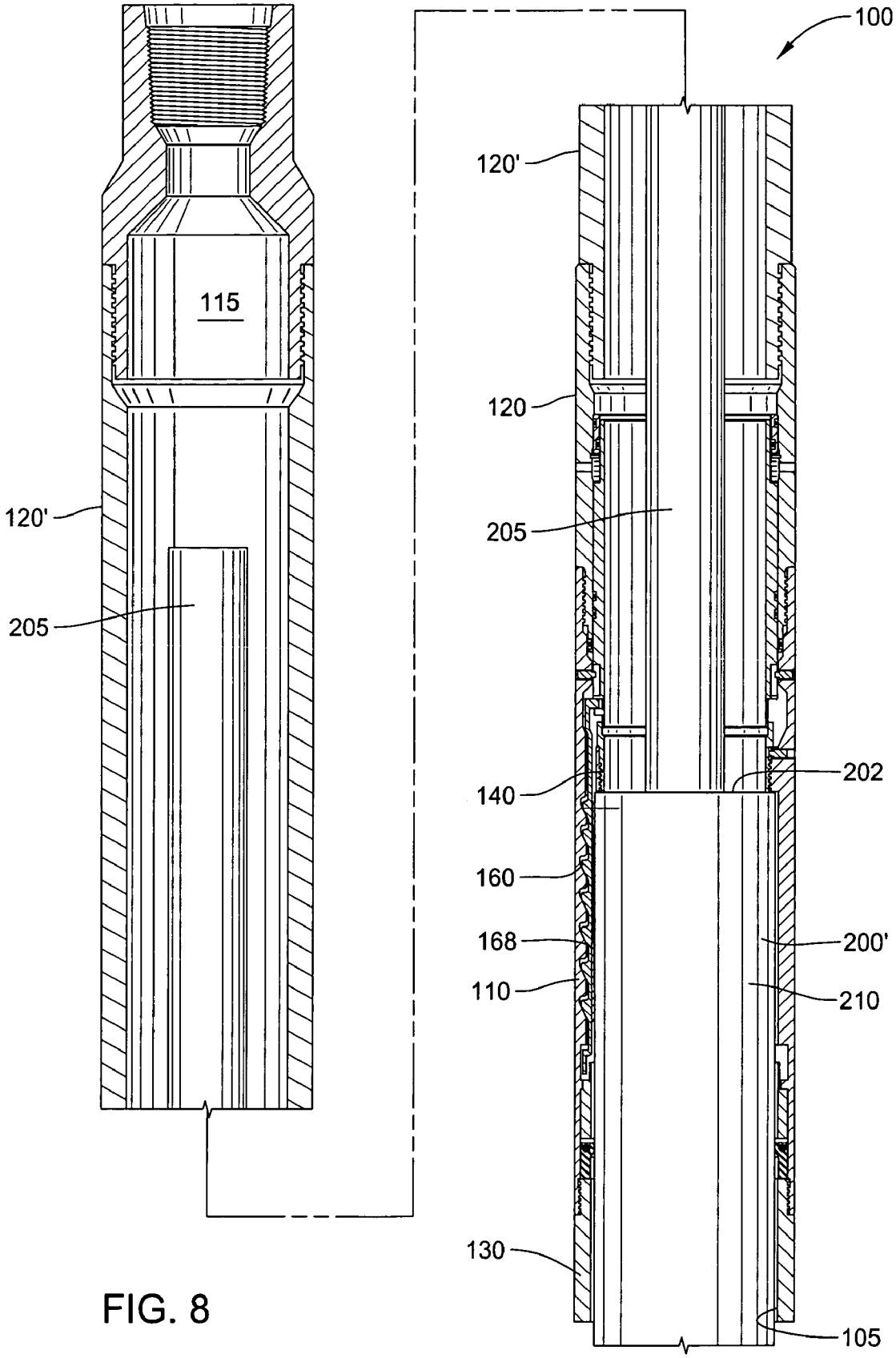
FIG. 8 presents a cross-sectional view of the overshot tool of FIG. 3, in a modified embodiment. In this view, the cylindrical housing is lengthened by the insertion of a tubular extension member between the upper body and the central body. In this manner, a longer "fish" can be "swallowed.

Finally, FIG. 8 presents a cross-sectional view of the overshot tool of FIG. 3, in a modified embodiment. In this view, the cylindrical housing is lengthened by the insertion of a tubular extension member 120' between the upper body 120 and the central body 110. In this manner, a longer "fish" 200' can be "swallowed." In FIG. 8, the item to be retrieved 200' includes a long shaft 205 that has been received within the overshot tool. The item 200' is representative of, for example, a joint of drill pipe that has parted. The gripping apparatus 160 is able to frictionally engage the joint 210 below the part. Alternatively, the fish 200' is representative of a mud motor having a parted shaft 205. The gripping apparatus 160 is able to frictionally engage the housing 210 of the mud motor.

While the foregoing is directed to embodiments of the present invention, other and further embodiments of the invention may be devised without departing from the basic scope thereof, and the scope thereof is determined by the claims that follow.

The invention claimed is:

1. A method for engaging a tubular body in a wellbore, comprising the steps of:

running an overshot tool into the wellbore on a working string, the overshot tool comprising:

housing having an inner surface and an outer surface, the outer surface forming an annulus within the surrounding wellbore;

a gripping member having an inner surface and an outer surface, the inner surface of the gripping member being dimensioned to receive the item in the wellbore, and the outer surface of the gripping member being slidably movable along the inner surface of the housing;

a fluid actuated piston disposed in the housing, the piston being operatively connected to the gripping member, and being slidably movable within the housing in response to a fluid pressure differential between the inner surface of the housing and the annulus so as to selectively move the gripping member between a first position in which the item is gripped and a second position in which the item is released; and a stop ring, the stop ring having an inner diameter that is smaller than the outer diameter of the body being retrieved from the wellbore, and being disposed between the piston and the gripping member;

tagging the stop ring on a surface of the tubular body to be retrieved; and pulling the working string so as to cause the gripping member to engage and grip the tubular body.

2. The method for engaging a tubular body of claim 1, further comprising the step of:

injecting fluid under pressure into the working string and connected overshot tool, thereby releasing the gripping member from the tubular body.

3. The method for engaging a tubular body of claim 2, wherein the gripping member comprises at least two radially arranged slip members.

4. The method for engaging a tubular body of claim 3, wherein the gripping member comprises at least three radially arranged slip members, each slip member having an upper tang for connecting to the piston.

5. The method for engaging a tubular body of claim 3, further comprising:

at feast two ramp surfaces on the inner surface of the housing; and at least two ramp surfaces on the outer surface of each of the slip members dimensioned to nest and move slidably along the at least two ramp surfaces on the inner surface of the housing.

6. The method for engaging a tubular body of claim 5, wherein the housing comprises:

a central body portion, an inner surface of the central body portion having the ramp surfaces that receive the gripping member; and an upper body portion, an inner surface of the upper body portion slidably receiving the piston, and the upper body portion having at least one port.

7. The method for engaging a tubular body of claim 6, wherein the housing is dimensioned to swallow a fish.

8. The method for engaging a tubular body of claim 7, wherein the housing further comprises a tubular extension disposed between the central body portion and the upper body portion.

9. The method for engaging a tubular body of claim 8, wherein the fish defines a mud motor having a shaft and a motor housing.

10. The method for engaging a tubular body of claim 8, wherein the fish defines a joint of parted pipe.

11. The method for engaging a tubular body of claim 7, wherein the piston further comprises:

a lower shoulder in fluid communication with the inner surface of the housing; and an upper shoulder in fluid communication with the annulus by means of the at least one port.

12. The method for engaging a tubular body of claim 5, wherein each of the slip members substantially recedes into the housing when the slip members nest within the at least two ramp surfaces, thereby enabling release of the tubular body.

13. The method for engaging a tubular body of claim 2, further comprising wickers along the inner surface of the gripping member for engaging the body in the wellbore when the overshot tool is pulled.

14. The method for engaging a tubular body of claim 2, wherein the piston has an inner diameter dimensioned to receive a wireline-deployed string shot therethrough.

15. An overshot tool for retrieving an item from within a wellbore, the overshot tool comprising:

a housing comprising an inclined inner surface;

a gripping member disposed in the housing and comprising:

an inclined outer surface which mates with the inclined inner surface of the housing, and wickers disposed along the inner surface of the gripping member;

a piston disposed in the housing and coupled to the gripping member, the piston disengaging the gripping member from the item when actuated by fluid pressure; and a stop ring having an inner dimension that is smaller than the outer diameter of the item being retrieved from the wellbore and being disposed between the piston and the gripping member.

16. The overshot tool of claim 15, wherein a smallest inside diameter of any of the housing, gripping member, or piston is substantially the same as the outside diameter of the item.

17. The overshot tool of claim 15, further comprising a sub for coupling the housing to a working string, wherein a smallest inside diameter of any of the housing, gripping member, or piston is the same or greater than a smallest inside diameter of the sub.

18. The overshot tool of claim 15, wherein a smallest inside diameter of any of the housing, gripping member, or piston is substantially constant along a length of the overshot tool.

19. The overshot tool of claim 15, wherein the overshot tool does not comprise a nozzle for actuating the piston.

20. The overshot tool of claim 15, wherein the housing and the gripping member each comprise a plurality of inclined inner surfaces.

21. The overshot tool of claim 15, further comprising a seal configured to engage an outside surface of the item.

22. The overshot tool of claim 15, wherein the gripping member is actuatable among an engaged position, a partially engaged position, and a disengaged position.

23. The overshot tool of claim 22, wherein the gripping member is actuatable from a partially engaged position to an engaged position by pulling the housing.

24. The overshot tool of claim 22, further comprising a biasing member which biases the gripping member toward the engaged position.

25. The overshot tool of claim 15, wherein the housing is long so that it may receive a long portion of the item in order to engage a second portion of the item.

26. The overshot tool of claim 25, further comprising a second gripping member disposed in the housing and comprising:

an inclined outer surface which mates with the inclined inner surface of the housing, and wickers disposed along the inner surface of the gripping member, wherein the gripping members are slips.

27. A method of using an overshot tool to retrieve an item from a wellbore, comprising:

providing the overshot tool, comprising a housing, a gripping member, and a piston;

running the overshoot tool into the wellbore on a workstring until a portion of the item is received into the housing, thereby actuating the gripping member to a partially engaged position;

pulling the workstring, thereby actuating the gripping member from a partially engaged position to an engaged position; and injecting a fluid through the workstring, the overshoot tool, and the item, wherein the fluid will be choked by the item, thereby actuating the piston to disengage the gripping member from the item.

28. The method of claim 27, further comprising:

running a tool through the overshot tool on a wireline.

* * * * *